US005477872A

United States Patent [19]

Berg

[11] Patent Number: 5,477,872

[45] Date of Patent: Dec. 26, 1995

[54] INFORMATION DEVICE FOR A WASHING APPARATUS WHICH INFORMS WHETHER THE CONTENTS ARE CLEANED OR SOILED

[76] Inventor: Floyd L. Berg, 24391 Wagonwheel La., Lake Elsinore, Calif. 92532

[21] Appl. No.: 334,944

[22] Filed: Nov. 7, 1994

[51] Int. Cl.[6] ..... A47L 15/42

[52] U.S. Cl. ..... 134/52; 116/200; 134/104.2; 134/113

[58] Field of Search ..... 134/46, 52, 93, 134/99.2, 104.2, 113; 116/200, 215, 277; 137/559; 141/359

[56] References Cited

U.S. PATENT DOCUMENTS 2,668,548 2/1954 Federighi et al. ..... 134/46

4,129,954 12/1978 Hulteen ..... 134/113 X 5,107,706 4/1992 Tolf ..... 134/113 X

*Primary Examiner*—Philip R. Coe

*Attorney, Agent, or Firm*—Ladas & Parry

[57] ABSTRACT

A device for use in a washer for the automatic washing of articles, the washer having a rack or racks to hold such articles. The device informs the user of the washer whether the articles in the washer are clean or soiled. The device catches a portion the liquid utilized by the washer and a release mechanism for releasing this liquid when articles are removed from the washer. Thus, if the device contains liquid, that indicates that the articles are clean. If empty, it indicates that the articles are soiled.

11 Claims, 1 Drawing Sheet

INFORMATION DEVICE FOR A WASHING APPARATUS WHICH INFORMS WHETHER THE CONTENTS ARE CLEANED OR SOILED

TECHNICAL FIELD

This invention relates to a warming system for an automatic dish washer. This system will warn whether the contents have been washed or are waiting to be washed. The warning system gives a visual indication, so that the user of the washer is less likely to add soiled articles to ones that are already clean, thus reducing the possibility of contaminating a clean load of articles with those needing to be washed.

BACKGROUND OF THE INVENTION

The automatic dishwasher is widely used in homes and restaurants to clean and sanitize table ware. It takes time for a cleaning cycle to complete its run. With the time pressures of modern society, the user of the automatic washer is not going to sit around and wait for the dishwasher to complete its cycle of washing and drying its contents, but rather the user will do other chores, go to work, rest or even go to sleep. Sometime later the user or a third party, such as another member of the user's family (if the washer is installed in a home) or a co-worker (if the dishwasher is installed in a restaurant) will add soiled dishes to those that are clean and will realize too late that the dishes in the washer were clean. Now the entire load of articles needs to be washed again to be sure that they are all clean. This results in aggravation and additional expense in hot water and soap and in lost time. An objective of this invention is to improve dishwashers so as to give a visual and/or an audible indication that the dishes in the washer are clean or soiled and thereby saving energy, soap, water and aggravation that occurs when dirty dishes are co-mingled with those that are clean.

These objectives are achieved as is now described. A washing machine has a cavity which accepts soiled articles, placed on movable racks dispersed in the cavity, and washes them in soapy water or other cleansing liquid, rinses the articles, optionally dries the articles and then holds them in the racks until removed. A typical automatic dishwasher has two racks which can, each, move into and out of the cavity to facilitate unloading clean dishes from the racks and loading soiled dishes into the racks. A water tight door, typically on the front of the machine, provides access to the washing cavity and the racks can move through the door's opening. The machine is provided with means for sensing when the articles to be washed are placed into the machine and when they are subsequently removed. Such a sensing means may be provided by a device which can hold the liquid washing solution until it is emptied by the washer user or by those means, such as a valve which is closed when a lever connected to is held down by a utensil and open when nothing is on the lever connected to the valve. The weight of the utensil would be the determining factor as whether the valve on the device is open or closed.

If this utensil is the last to be removed when the dishes or utensils are clean, the presence of liquid in the tube or device holding the washing solution which fills the device when the machine is washing would show that the dishes within the machine are clean when the device is filled with washing solution and soiled when this device is empty of washing solution. If economy is desired, the presence or absence of solution within the device will tell the user that the dishes are either soiled or clean, however, this will entail having the user to remember what the filled or empty conditions say about the cleanliness of the items with the washer. Words, such as clean or soiled may be placed upon the device at the top and bottom to help in remembering what the presence of absence of solution means as to the condition of the utensils within the washer. If the device holding the solution is transparent and has a floating device, which may be colored, within the device, the presence of a solution will be easier to detect. In order to add the device to washers presently in use the device may be made with a clip or similar aid so that it can be added to present washers. The addition of an electric warning signal might be prohibitive in cost but is certainly not impossible.

DETAILED DESCRIPTION OF THE DRAWINGS

Figure 1:
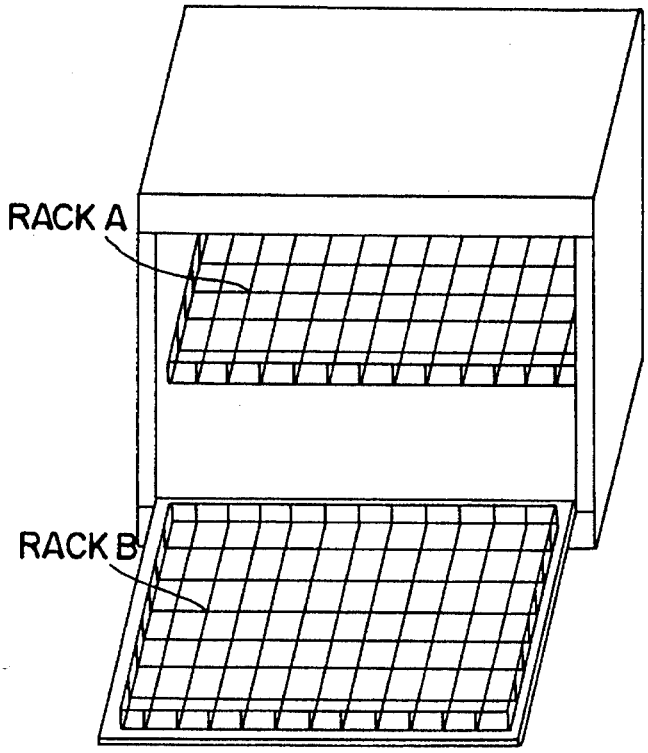
FIG. 1 depicts a conventional dishwasher having a cavity to receive dishes.
Figure 2:
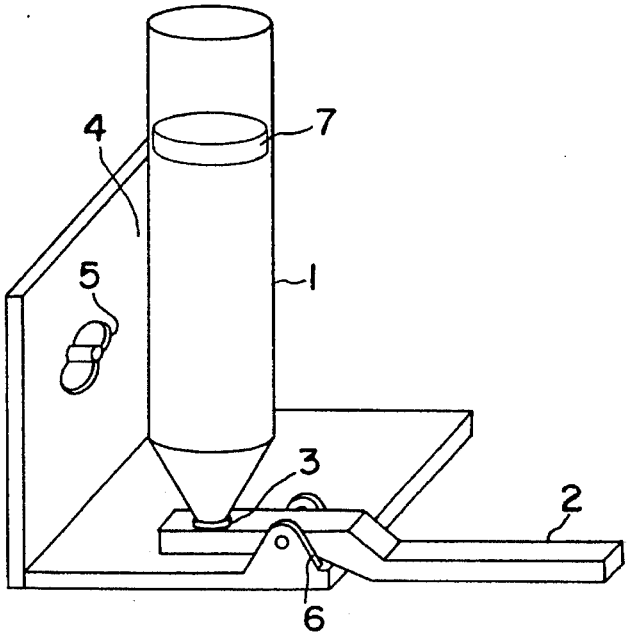
FIG. 2 depicts a preferred embodiment of the present invention.

FIG. one shows a conventional dishwasher with a cavity to receive dishes, a door to make it watertight and racks A and B to hold dishes and other implements. There are so many different designs of racks that the drawing only depicts a very simple type of rack.

FIG. two is a drawing of a tube #1 which is made so to hold water when the valve at #3 is closed by a weight such as a dish, glass, cup or other item with enough weight to hold the valve #3 closed. #4 shows a backing for the tube or other shape. The shape is not a necessary part of this patent. #5 shows a method of attaching the solution or water holder to the dish rack. This may not be necessary in those cases where the solution holder is made free standing. #2 is a lever which has the valve, pivot and arm, to hold the article to be washed, which holds the valve #3 closed and keeps the liquid from leaking out of the shape #1.

When a dish or other device is placed on arm #2, the valve, #3 is pushed against the escape hole on the liquid holder #1. This causes the liquid holder to catch the liquid of the cleaning cycle. When this part has water in it, it indicates that the dishes are in process or finished being washed. At the completion of the cleaning cycle, the liquid in this holder #1 indicates that the dishes are clean.

When the dishes are removed from the racks, the release of the lever #2 will allow the liquid to escape and indicate that the clean dishes have been removed and that any dishes within the machine are soiled and ready to be washed. The valve in the liquid holding device may be closed, but the absence of liquid indicates that the dishes are soiled. The liquid holder may be made of a transparent material so the liquid may be readily seen, and a floating device such as a colored ring, disk or other shape #7 may be added to aid in observing the presence or lack of liquid in container #1.

In order to keep the floating device from being carried away with overflowing washing liquid, a restraint may be provided to stop the floating device from floating out of the container #1. Also, a provision may be made to release some of the liquid to keep it from completely filling the container #1.

the lever #2 is weighted or has a spring added to it so as to make the valve #3 open when no implements are on the lever #2, and weak enough for the valve to hold the liquid in the container #1 when at item is placed on the lever #2.

Having described the invention in connection with a preferred embodiment thereof, modification may now suggest itself to those skilled in the art. Thus, the invention is not to be limited to the disclosed embodiment, except as required by the appended claims.

What is claimed is:

1. In a washer for the automatic washing of articles the washer having a rack or racks to hold such articles, a device to catch a portion the liquid utilized by the washer and a release mechanism for releasing this liquid when articles are removed from the washer.

2. The combination of claim 1, wherein said device comprises a vessel having transparent or translucent walls.

3. The combination of claim 1 wherein said release mechanism comprises a valve which is biased to a closed position by articles placed in said washer.

4. The combination of claim 3 wherein said device includes a vessel and a support plate, the vessel being mounted to said support plate and wherein said release mechanism includes a lever articulated to said support and a valve disposed adjacent an end of said lever, said valve, in a closed position thereof, closing an opening in said vessel.

5. The combination of claim 4 wherein said vessel is cylindrically-shaped and has an open upper end for catching the liquid.

6. The combination of claim 5 wherein said valve assumes it closed position when a relatively weighty article is placed on said lever and assumes an open position when the article is removed from said lever.

7. The combination of claim 3 wherein said vessel includes a floating device which floats on any liquid in said vessel.

8. A washing machine for washing articles and a sensing device disposed in said washing machine for detecting when the articles have been subjected to a cleaning cycle in said washing machine, said sensing device assuming a first display condition in response to the cleaning cycle, said sensing device also being responsive to the removal of an article or articles from said washer and assuming a second display condition in response thereto.

9. The washing machine of claim 8 wherein said sensing device includes a vessel for catching liquid during the cleaning cycle, a valve for holding the liquid caught in the vessel when the valve is closed and a release mechanism for opening the valve when an article or articles are removed from the washing machine.

10. The washing machine of claim 9 wherein said release mechanism comprises a member which is disposed in said washing machine to be moved to a first position in response to the placement of an article or articles in said washing machine and away from said first position when the articles are removed, said member in its first position closing said valve.

11. The washing machine of claim 10 wherein said vessel is transparent or translucent and is disposed in said washing machine at a location where said vessel may be easily viewed by a person operating said washing machine.

* * * * *